US012643717B2

(12) United States Patent
Omdahl, II et al.

(10) Patent No.: US 12,643,717 B2
(45) Date of Patent: Jun. 2, 2026

(54) BEVERAGE CONTAINER LID WITH SLIDING SEAL MECHANISM

(71) Applicant: Runway Blue, LLC, Lehi, UT (US)

(72) Inventors: John R. Omdahl, II, Lindon, UT (US); David O. Meyers, Layton, UT (US); David Bytheway, Springville, UT (US); Jim Allen Colby, Highland, UT (US); Paul James Faerber, Orem, UT (US)

(73) Assignee: Runway Blue, LLC, Lehi, UT (US)

( * ) Notice: Subject to any disclaimer, the term of this patent is extended or adjusted under 35 U.S.C. 154(b) by 37 days.

(21) Appl. No.: 18/781,480

(22) Filed: Jul. 23, 2024

(65) Prior Publication Data

US 2025/0033844 A1 Jan. 30, 2025

Related U.S. Application Data

(60) Provisional application No. 63/515,952, filed on Jul. 27, 2023.

(51) Int. Cl.
*B65D 47/28* (2006.01)
*A47G 19/22* (2006.01)
(Continued)

(52) U.S. Cl.
CPC ..... *B65D 47/286* (2013.01); *A47G 19/2272* (2013.01); *B65D 43/0202* (2013.01);
(Continued)

(58) Field of Classification Search
CPC .... B65D 47/32; B65D 47/268; B65D 47/261; B65D 47/26; B65D 43/0202; B65D 43/20;
(Continued)

(56) References Cited

U.S. PATENT DOCUMENTS 3,739,938 A * 6/1973 Paz ..... B65D 47/248 D7/510
4,136,799 A * 1/1979 Albert ..... B65D 47/249 220/592.16
(Continued)

FOREIGN PATENT DOCUMENTS

CA 3189791 A1 2/2022

OTHER PUBLICATIONS

International Search Report and Written Opinion for PCT/US2024/039141, mailed Nov. 12, 2024, 15 pages.

*Primary Examiner* — Robert J Hicks
(74) *Attorney, Agent, or Firm* — Sterne, Kessler, Goldstein & Fox P.L.L.C.

(57) ABSTRACT

A lid for a beverage container including a lid body defining a drinking passageway extending between a drinking opening at an upper rim of the lid body and a drinking passageway inlet at an interior of the lid body. The lid includes an actuator accessible from an exterior of the lid body and a sealing apparatus coupled to the actuator and located at least partially in an interior of the lid body. The actuator and the sealing apparatus can slide relative to the lid body between a sealed position and an unsealed position. In the sealed position a sealing member of the sealing apparatus contacts an interior surface of the lid body around the drinking passageway inlet to seal the drinking passageway.

20 Claims, 5 Drawing Sheets

(51) Int. Cl.
*B65D 43/02* (2006.01)
*B65D 47/32* (2006.01)

(52) U.S. Cl.
CPC ..... *B65D 47/32* (2013.01); *B65D 2205/02* (2013.01); *B65D 2543/00046* (2013.01); *B65D 2543/00092* (2013.01)

(58) Field of Classification Search
CPC .... B65D 43/12; B65D 51/1672; B65D 51/18; B65D 2205/02; B65D 2251/0018; B65D 2251/0003; B65D 2543/00046; B65D 2543/00018; B65D 2543/00092; A47G 19/2272; A47G 19/2266
USPC ... 220/254.9, 254.1, 259.5, 256.1, 713, 715, 220/714, 711, 348, 345.4, 345.6, 345.1, 220/345.5
See application file for complete search history.

(56) References Cited

U.S. PATENT DOCUMENTS

| | | | | |
|---|---|---|---|---|
| 6,702,137 | B1 * | 3/2004 | Kowa | A47J 41/0027 220/254.1 |
| 6,752,287 | B1 * | 6/2004 | Lin | A47G 19/2272 220/254.9 |
| 2015/0060448 | A1 * | 3/2015 | Coon | B65D 43/0225 220/254.1 |
| 2020/0055646 | A1 | 2/2020 | Harris et al. | |

* cited by examiner

BEVERAGE CONTAINER LID WITH SLIDING SEAL MECHANISM

CROSS-REFERENCE TO RELATED APPLICATIONS

This application claims the benefit of U.S. Provisional Patent Application No. 63/515,952 filed Jul. 27, 2023, which is incorporated herein in its entirety by reference thereto.

FIELD

This disclosure generally relates to containers for beverages. More specifically, some embodiments relate to beverage container lids with sliding seal mechanisms.

BACKGROUND

It may be desirable for a beverage container to have a sealed position, in which a drinking opening of the beverage container is sealed, and an open position, in which the drinking opening is not sealed. It may further be desirable for the container to be able to equalize its internal pressure with external pressure by providing a vent between its interior and the external atmosphere.

SUMMARY

Some embodiments disclosed herein are directed to a lid for a beverage container including a lid body, an actuator accessible from an exterior of the lid body, and a sealing apparatus coupled to the actuator and located at least partially in an interior of the lid body. The lid body defines a drinking passageway extending between a drinking opening at an upper rim of the lid body and a drinking passageway inlet at an interior of the lid body. The actuator and the sealing apparatus can slide relative to the lid body between a closed position in which the drinking passageway is sealed, and an open position in which the drinking passageway is not sealed. The actuator and the sealing apparatus enter a venting position in order to move from the closed position to the open position.

In some embodiments, the actuator moves downward relative to the lid body to enter the venting position, and to slide away from the drinking passageway to move from the closed position to the open position. The sealing apparatus of the lid may include a sealing member that contacts an interior surface of the lid body around the drinking passageway inlet to seal the drinking passageway when the sealing apparatus is in the closed position.

In some embodiments, the lid body defines an actuator opening therethrough. A portion of the actuator or a portion of the sealing apparatus extends through the actuator opening to couple the actuator to the sealing apparatus. An air pathway can be established through the actuator opening when the sealing apparatus is in the venting position. The sealing apparatus includes a first sealing member and a second sealing member. The first sealing member can seal the drinking opening when the sealing apparatus is in the closed position, and the second sealing member can seal the actuator opening when the sealing apparatus is in the closed position. In some examples, when the sealing apparatus is in the venting position the second sealing member does not seal the actuator opening.

In some embodiments, the lid includes a stop that prevents the actuator and the sealing apparatus from moving from the closed position to the open position. Pressing the actuator downward can move the actuator and the sealing apparatus downward into the venting position, thereby unsealing the actuator opening and bypassing the stop. When the actuator is disassembled from the sealing apparatus, the sealing apparatus is rotatable relative to the lid body to a position in which the sealing apparatus is removable from the lid body. In some examples, the sealing apparatus includes a sealing member that contacts an interior surface of the lid body around the drinking passageway inlet to seal the drinking passageway when the sealing apparatus is in the closed position. The sealing apparatus can include a coupling flange, and a lower surface of the coupling flange plate can abut an upper surface of the lid body to hold the sealing member against the interior surface of the lid body. In some examples, the actuator can be positioned entirely below the drinking opening. In an embodiment, the actuator can be positioned entirely below the upper rim of the lid. The lid can include a central vertical axis, and the central vertical axis of the lid can pass through the actuator. The lid can include a vessel, and the lid can attach to the vessel to close an interior volume of the vessel.

Some embodiments disclosed herein are directed to a lid for a beverage container including a lid body and a sealing apparatus located at least partially in an interior of the lid body. The lid body defines a drinking passageway extending between a drinking opening positioned at a front of the lid and a drinking passageway inlet positioned at an interior of the lid body. The sealing apparatus can slide relative to the lid body between a closed position in which the drinking passageway is sealed, and an open position in which the drinking passageway is not sealed. The sealing apparatus slides away from the front of the lid along a travel axis when sliding from the closed position to the open position. An interior surface of the lid body around the drinking passageway inlet is angled downward toward a front of the lid, relative to the travel axis, and a portion of the sealing apparatus that seals the drinking opening is angled downward toward the front of the lid, relative to the travel axis.

In some embodiments, the interior surface of the lid body around the drinking passageway inlet and the portion of the sealing apparatus that seals the drinking opening are angled relative to the travel axis at the same angle. The interior surface of the lid body around the drinking passageway inlet and the portion of the sealing apparatus that seals the drinking opening can be angled relative to the travel axis at an angle of 2 degrees to 10 degrees. In some examples, the interior surface of the lid body around the drinking passageway inlet and the portion of the sealing apparatus that seals the drinking opening are angled relative to the travel axis at an angle of 5 degrees. The lid body can define a shelf formed in an inner side wall of the lid body at a front of the lid body, and a portion the sealing apparatus can be positioned on the shelf when the sealing apparatus is in the closed position. In some examples, the drinking opening is positioned at an upper front of a rim of the lid.

Some embodiments disclosed herein are directed to a lid for a lid for a beverage container including a lid body and a sealing apparatus located at least partially in the interior of the lid body. The lid body defines a drinking passageway extending between a drinking opening at an upper rim of the lid body and a drinking passageway inlet at an interior of the lid body. The sealing apparatus is slidable relative to the lid body between a closed position in which the drinking passageway is sealed and an open position in which the drinking passageway is not sealed. A sealing member of the sealing apparatus contacts an interior surface of the lid body around the drinking passageway inlet to seal the drinking passageway when the sealing apparatus is in the closed position. The portion of the sealing apparatus that contacts the interior surface of the lid body around the drinking passageway inlet when the sealing apparatus is in the closed position does not contact the interior surface of the lid body when the sealing apparatus is in the open position.

In some embodiments, the portion of the sealing apparatus that contacts the interior surface of the lid body around the drinking passageway inlet when the sealing apparatus is in the first position does not contact the lid body along a majority of the travel path from the first position to the second position.

BRIEF DESCRIPTION OF THE FIGURES

The accompanying drawings, which are incorporated herein and form a part of the specification, illustrate the present disclosure and, together with the description, further serve to explain the principles thereof and to enable a person skilled in the pertinent art to make and use the same.

DETAILED DESCRIPTION

Figure 1:
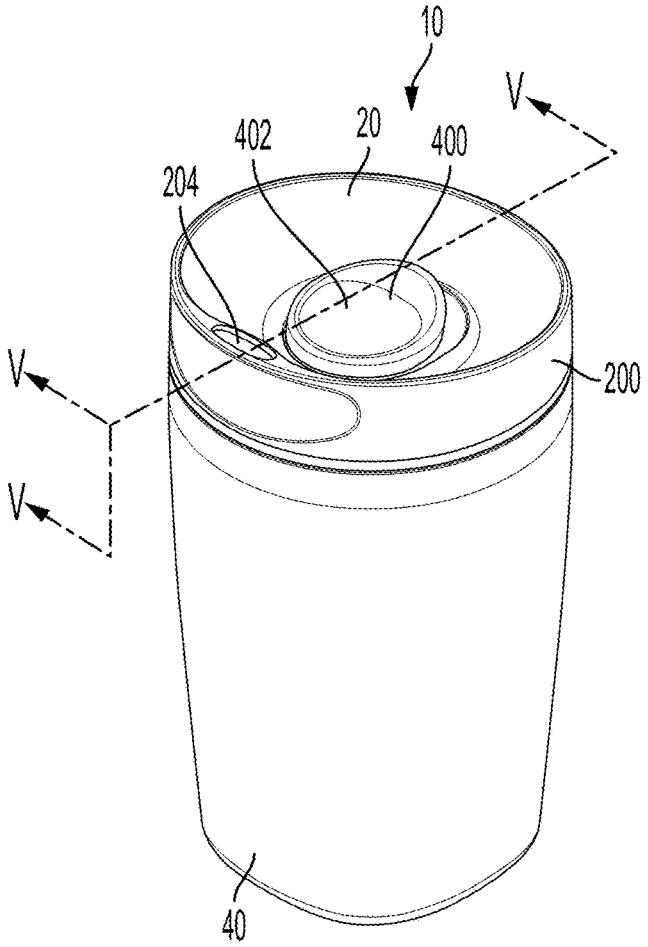
FIG. 1 shows an upper front perspective view of a container.

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein comport with standards used by those experienced or skilled in the art to most effectively convey the substance of their work to others skilled in the art. In some instances, well-known methods, procedures, components, and elements have not been described in detail to avoid unnecessarily obscuring aspects of the disclosure.

References in the specification to "one embodiment," "an embodiment," "an example embodiment," "some embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, this disclosure has been prepared such that when a particular feature, structure, or characteristic is described in connection with an embodiment, it is within the knowledge of one skilled in the art to apply such feature, structure, or characteristic in connection with other embodiments whether or not explicitly described.

The following examples are illustrative, but not limiting, of the present disclosure. Other suitable modifications and adaptations of the variety of conditions and parameters normally encountered in the field, and which would be apparent to those skilled in the art, are within the spirit and scope of the disclosure.

People use reusable beverage containers to carry a variety of beverages. It is often desirable for a beverage container to have a sealing mechanism to seal a drinking opening of the beverage container when a user is not drinking from it. Sealing the drinking opening can, for example, allow a user to carry the beverage container without worrying that the beverage being carried will leak on the user or the user's belongings. Sealing the drinking opening can also, for example, allow the beverage being carried to maintain a desired temperature. Users may appreciate a beverage container that can be easily sealed and unsealed so that the user can easily drink from the beverage container.

It may also be desirable for a beverage container to have relatively few components exposed to an exterior of the beverage container. This may be desirable, for example, so that dirt or debris on certain components does not contaminate a beverage within the beverage container or so that there are relatively few component for a user to clean.

It may also be desirable for a container to be able to vent to an external atmosphere before it is completely open, to avoid venting through the opening, which can be unpleasant or undesirable to a user.

Some embodiments of the present disclosure provide a lid for a beverage container that can be used to easily seal and unseal a drinking opening. To facilitate ease of use and straightforward operation by a user, the lid may include a sliding sealing assembly, controlled by an actuator accessible at a top of the lid. To maintain an effective seal, the sliding assembly may establish two seals: one around an internal end of a drinking passageway, and one around an opening for the actuator.

To help establish and maintain an effective seal around the drinking opening, the lid body may include internal retention tabs, and sealing features of the sealing assembly may be angled to—in cooperation with the retention tabs—be held securely around the internal end of the drinking passageway, sealing it tightly.

To permit venting (e.g., to equalize a pressure difference to internal pressure buildup while sealed) before opening the drinking passageway, in some embodiments moving the actuator from a closed, sealed position to an open position involves passing through a closed, venting position, which vents through the actuator opening. This avoids venting out the drinking opening, which may be unpleasant or undesirable to a user.

To effect these and other features in a way that is straightforward to a user while still being easy to assemble and disassemble (e.g., for washing), some embodiments include a configuration of ribs between parts of the sealing assembly and the lid, such that the ribs interact to guide and restrict movement of the sealing assembly relative to the lid while the two parts are being rotated and translated relative to each other during assembly or disassembly, such that—to an end user—their assembly or disassembly appears straightforward and intuitive, while still providing a strong seal and operation when assembled.

These and other embodiments are discussed below in more detail with reference to the figures.

Figure 2:
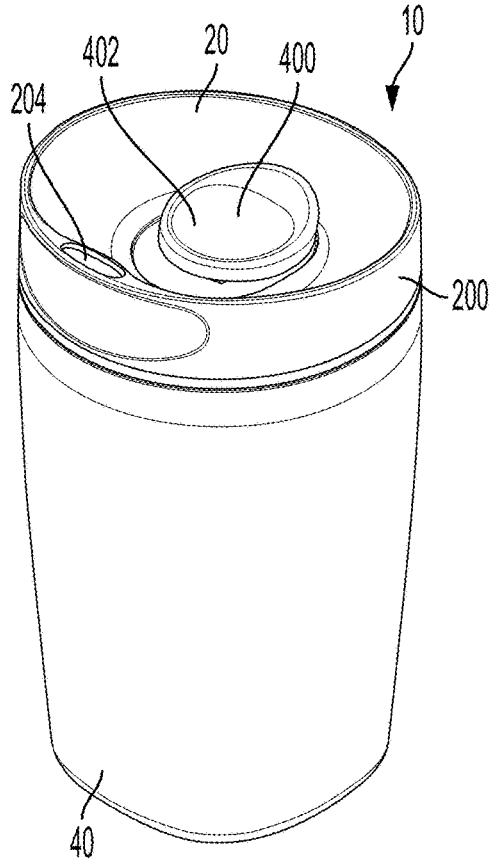
FIG. 2 shows an upper front perspective view of a container of the container of FIG. 1 with its actuator in a different position.

FIGS. 1 and 2 show a container 10 according to some embodiments. Container 10 may be, for example, a reusable beverage container. Container 10 may include a vessel 40 and a lid 20 for vessel 40. Lid 20 may include multiple components, including a lid body 200 and an actuator 400. Container 10 may be, for example a container for drinking a beverage from, such as a beverage container.

Lid body 200 may include a drinking opening 204 through which a user can drink a beverage contained within vessel 40 when lid 20 is assembled with vessel 40. Lid body 200 may be formed of food-grade plastic (e.g., polypropylene, copolyester, the copolymer sold as Eastman Tritan, high-density polyethylene (HDPE), polyoxymethylene (POM), or acrylonitrile butadiene styrene (ABS)), or metal (e.g., steel, stainless steel, aluminum, copper, or titanium), and in some embodiments may be formed as a single, unitary piece.

Lid 20 when assembled with vessel 40 can create a seal. The term seal as used here and elsewhere in this document does not necessarily require a perfect hermetic seal; rather a seal capable of inhibiting passage of liquid fluid is sufficient. Drinking opening 204 and an opening beneath actuator 400 (actuator opening 206, shown in other figures) may define the only openings extending though lid body 200 to vessel 40, and drinking opening 204 and actuator opening 206 may be internally sealed, as will be discussed in greater detail below.

Actuator 400 may be accessible from an exterior of lid body 200. Actuator 400 may be or include, for example, a button (e.g., slidable button 402), a switch, a lever, or other suitable mechanical mechanism. Actuator 400 may be moveable between a first position (e.g., a closed position as shown in FIG. 1) and a second position (e.g., an open position as shown in FIG. 2) in order to unseal or seal drinking opening 204, as will be discussed in greater detail below. In some embodiments, to help protect actuator 400 it may be positioned below an upper edge of rim 202 (and below drinking opening 204). In some embodiments, to help facilitate easy access and use of actuator 400, actuator 400 may be positioned centrally on lid body 200, for example at a position where a central vertical axis of lid 20 passes through actuator 400.

In embodiments where actuator 400 is or includes a button 402, actuator 400 may be moveable from the first position to the second position, for example, by sliding button 402 away from drinking opening 204, and from the second position to the first position, for example, by sliding button 402 toward drinking opening 204. Some embodiments optionally involve a user pressing actuator down (e.g., to bypass a stop and/or open a venting pathway) before or while sliding actuator 400 from the first position to the second position. Actuator 400 may be formed of any suitable material (e.g., polypropylene, copolyester, the copolymer sold as Eastman Tritan, high-density polyethylene (HDPE), polyoxymethylene (POM), or acrylonitrile butadiene styrene (ABS)), glass, or metal (e.g., steel, stainless steel, aluminum, copper, or titanium), and in some embodiments may be formed as a single, unitary piece.

Figure 3:
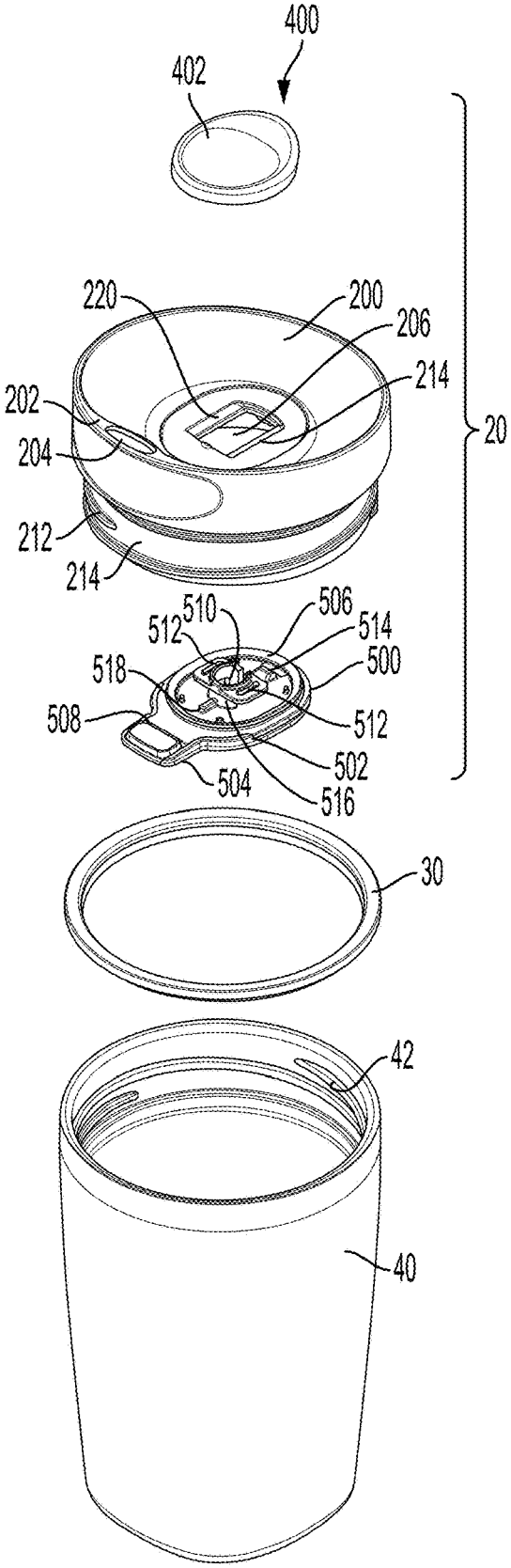
FIG. 3 shows an exploded upper front perspective view of the container of FIG. 1.
Figure 4:
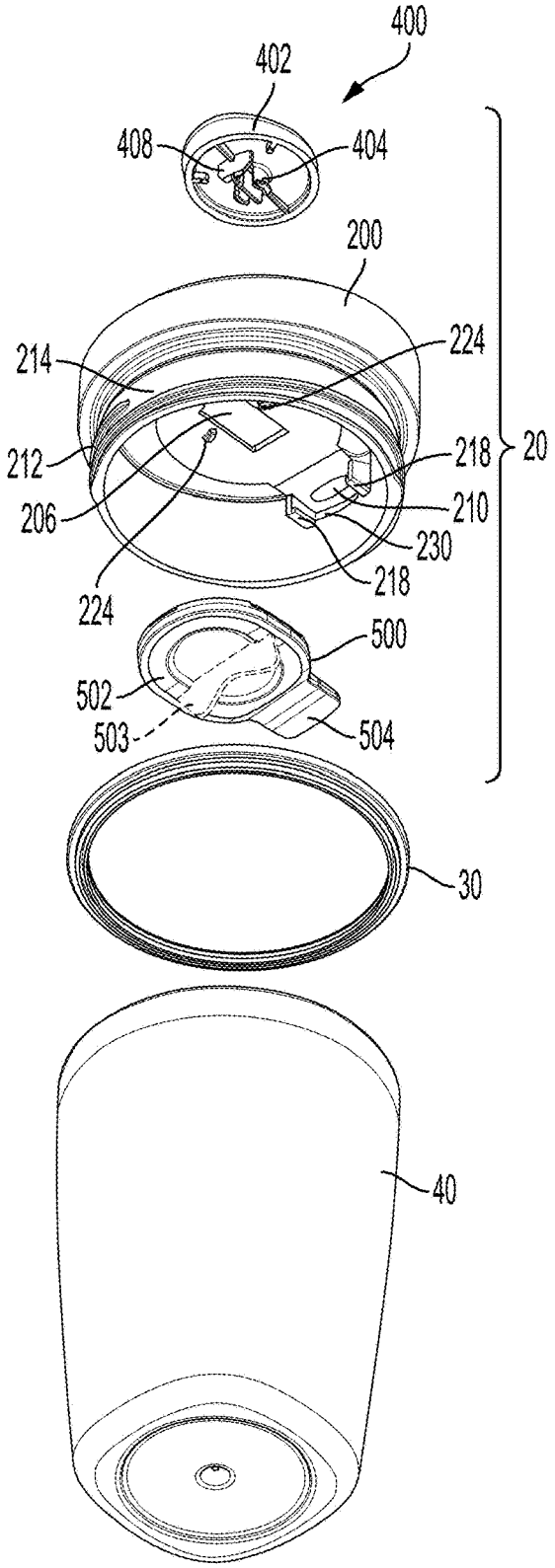
FIG. 4 shows an exploded lower rear perspective view of the container of FIG. 1.

FIGS. 3 and 4 show exploded views of container 10 according to some embodiments. As shown, lid 20 includes lid body 200, actuator 400, and sealing apparatus 500. Container 10 may also include a gasket 30 and vessel 40.

A drinking passageway 208 (see, e.g., FIG. 5A) may extend through lid body 200 (e.g., through an upper rim 202 which may define a spout). Such drinking passageway may extend between drinking opening 204 at an exterior of lid body 200, and drinking passageway inlet 210 at an interior of lid body 200.

Actuator opening 206 may also extend through lid body 200, and may be spaced away from drinking passageway 208. For example actuator opening 206 may be positioned at a central position of lid body 200, while drinking passageway 208 may be positioned nearer to an edge of lid body 200 (e.g., at rim 202).

When assembled, a sealing assembly formed of actuator 400 and sealing apparatus 500 may extend through actuator opening 206. For example, a connector 404 of actuator 400 may couple to a connector 510 of sealing apparatus 500, either or both of which may extend through actuator opening 206. For example, connector 404 and connector 510 may couple together in fixed positions relative to each other by, e.g., a snap fit (as shown), a press fit, a threaded connection, or any other suitable connection. In some embodiments, as will be discussed in more detail, connector 404 and connector 510 are removably connected, to facilitate disassembly and reassembly.

The connector 404 may extend from a bottom surface of actuator 400, and may include arms and connector flanges. The arms may extend downward relative to the bottom surface of actuator 400, and the connector flanges may extend laterally from each arm. When assembled, the connector flanges may extend towards side wall 214. Each connector flange may include a forward side and a rearward side. The forward side and the rearward side may converge as each connector flange extends radially from each arm. In other words, a length measured from the forward side to the rearward side of each connector flange may be greater proximal to the arm relative to the length measured at a distal location. In some examples, the forward side may have a greater angle of convergence relative to the rearward side (i.e., as the connector flanges extend radially from the arm, the forward side may taper inwardly more than then rearward side).

While connected, the connection between connector 404 and connector 510 fix the positions of actuator and sealing member relative to each other, forming the sealing assembly. The assembly can be moved relative to lid body 200. For example, as will be discussed in greater detail, the assembly can translate (e.g., slide) forward and backward toward and away from drinking passageway 208, to thereby seal and unseal it. A user may slide actuator 400 (e.g., by sliding button 402 of actuator), disposed on and accessible from an exterior side of lid 20, which, due to their connection, will correspondingly slide sealing apparatus 500 disposed on an internal side of lid 20.

Sealing apparatus 500 may include, on an upper side thereof, one or more sealing members to seal drinking passageway inlet 210 and actuator opening 206. For example, sealing apparatus 500 may include an actuator opening sealing member 506 disposed on a main body 502 of sealing apparatus 500, and may include a drinking passageway sealing member 508 disposed on a tongue 504 of sealing apparatus 500. Tongue 504 may extend from main body 502 as shown, for example, in FIG. 3.

Such sealing members may be formed of a resilient material (e.g., silicone) and are more resilient than, for example, the main body 502 and tongue 504 on which they are disposed. As shown in the figures, such sealing members may be formed of continuous raised portions forming a closed shape (where the closed shape is shaped and configured to fit around the opening to be sealed). In some embodiments actuator opening sealing member 506 and drinking passageway sealing member 508 are together formed as a single, unitary piece (as shown), however actuator opening sealing member 506 and drinking passageway sealing member 508 may also be formed as separate pieces.

Actuator opening sealing member 506 may be large enough to extend around (and thereby seal) actuator opening 206 whether the sealing assembly is in the open or closed configuration. Drinking passageway sealing member 508 may be sized to fit closely around (and thereby seal) drinking passageway inlet 210, such that drinking passageway sealing member 508 seals drinking passageway inlet when the sealing assembly is in the closed position, but is moved away from (and thereby does not seal) drinking passageway inlet 210 when the sealing assembly is in the open position.

The sealing assembly is coupled to lid body 200 at and around actuator opening 206. When assembled, coupling flanges 512 of sealing apparatus 500 will extend above an exterior surface of lid body 200, while most of sealing apparatus 500 is disposed at an interior surface of lid body. In this way, flanges 512 help retain the lower portions of sealing apparatus 500 in contact against such interior surfaces of lid body 200. For example, as shown, coupling flanges 512 will be positioned on tracks 220 formed in the exterior surface of lid body 200, adjacent actuator opening 206. A portion of lid body 200 (e.g., corresponding to tracks 220 as shown) may be thereby disposed between flanges 512 and the lower portions of sealing apparatus 500.

The gap between flanges 512 and main body 502 is sized so as to press actuator opening sealing member 506 and drinking passageway sealing member 508 against interior surfaces of lid body 200, so they can effect their sealing function, as will be described in greater detail.

In some embodiments, sealing apparatus 500 may include a bottom side with a gripping member 503 that extends from the bottom side. Gripping member 503 is optional, shown in broken lines. When assembled, gripping member 503 may extend downward towards the bottom of vessel 40. In some examples, gripping member 503 may extend laterally across the bottom side of main body 502. A user may manipulate the sealing apparatus 500 via gripping member 503, for example, as sealing apparatus 500 and lid body 200 transition from a disassembled arrangement to an assembled arrangement, or vice versa.

Lid body 200 may include attachment mechanism 212 on a lower side wall 214 of lid body 200. Vessel 40 may include a corresponding attachment mechanism 42 near an upper edge of the vessel, configured to engage with attachment mechanism 212 to removably attach vessel 40 to lid 20. Attachment mechanisms 212 and 42 may be threaded connectors (as shown in FIG. 3), friction fit connectors, snap-fit connectors, or any other suitable releasable attachment mechanism. The attachment of lid body 200 to vessel 40 is not limited to the arrangement shown in the figures. For example, in some embodiments, lid body 200 may attach over vessel 40 rather than inside vessel 40.

When assembled with vessel 40, lid sealing member 30 may be pressed between lid body 200 and an inner and/or upper surface of vessel 40, to create a seal between lid body 200 and vessel 40. Lid sealing member 30 may be a removable component (e.g., a removable gasket), or may be an integrally-formed part of lid body 200 or vessel 40.

Figure 5A:
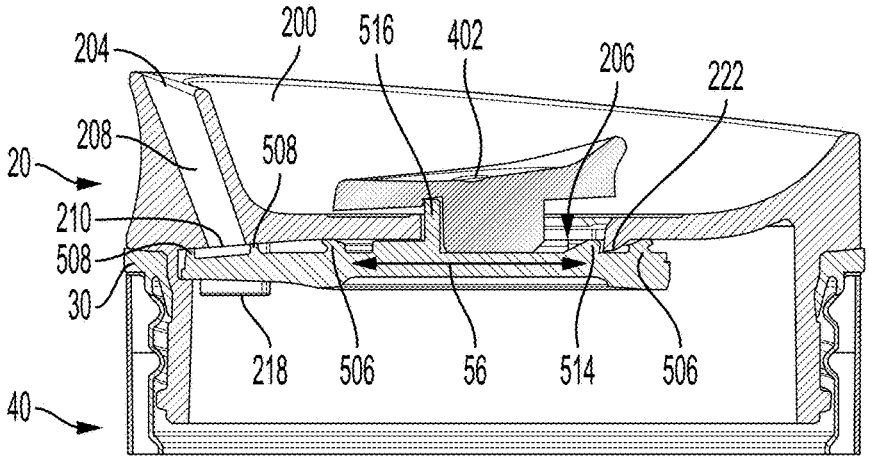
FIG. 5A shows a sectional view of a portion of the container of FIG. 1 with its lid in a closed sealed configuration, taken at the position of line V of FIG. 1.
Figure 5B:
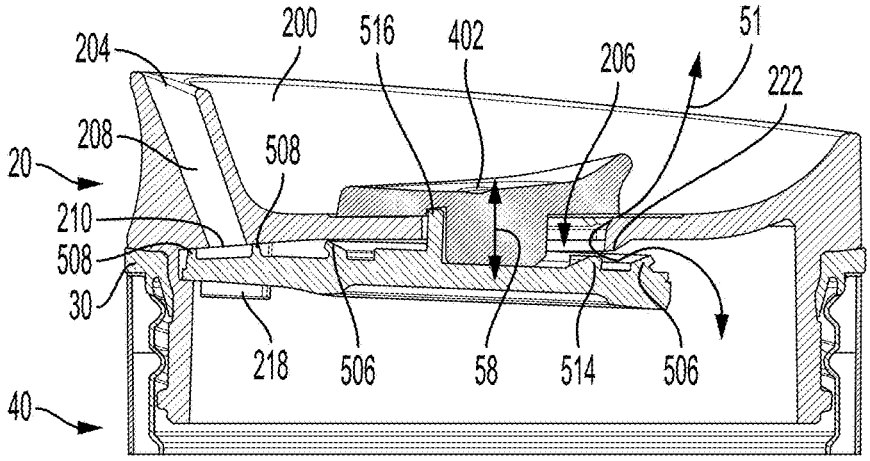
FIG. 5B shows a sectional view of a portion of the container of FIG. 1 with its lid in a closed venting configuration, taken at the position of line V of FIG. 1.
Figure 5C:
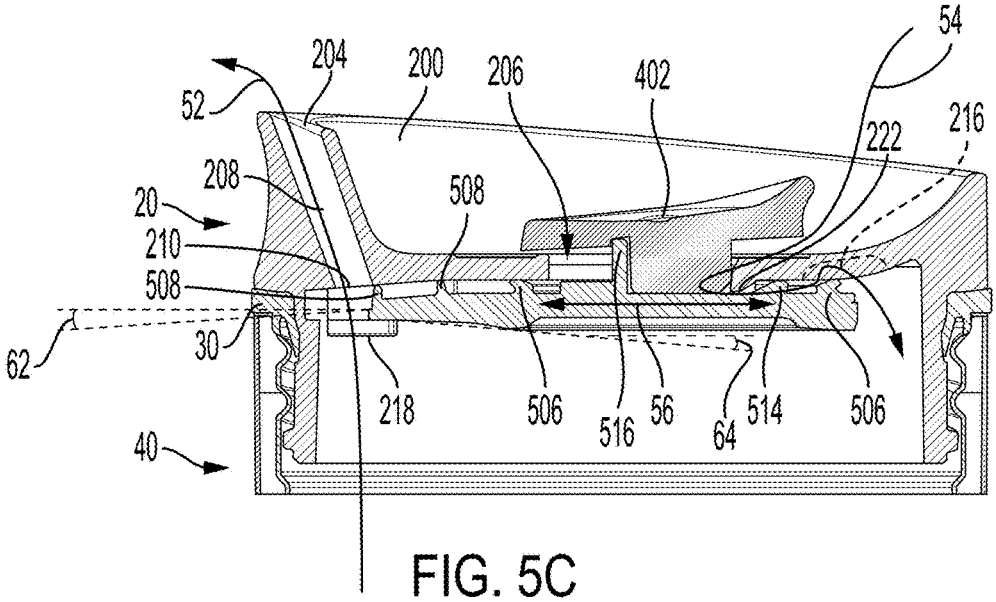
FIG. 5C shows a sectional view of a portion of the container of FIG. 1 with its lid in an open configuration, taken at the position of line V of FIG. 1.

FIGS. 5A and 5C show lid 20 in, respectively, a first, closed configuration, and a second, open configuration. In the first, closed, configuration (FIG. 5A), actuator opening sealing member 506 is in continuous contact with the interior surface of lid body 200 entirely around actuator opening 206, thereby sealing actuator opening 206. And drinking passageway sealing member 508 is in continuous contact with the interior surface of lid body 200 entirely around drinking passageway inlet 210, thereby sealing drinking passageway 208.

In the second configuration (FIG. 5C) actuator button 402 has been slid rearward (away from drinking opening 204) by a user wishing to open and drink from drinking opening 204. In this open configuration, drinking passageway sealing member 508 is correspondingly slid rearward and is removed from drinking passageway inlet 210. That is, drinking passageway sealing member 508 is not disposed around drinking passageway inlet 210 and does not seal drinking passageway inlet. The user may drink from container 10 by pouring liquid out through drinking passageway 208. Arrow 52 shows an example fluid exit pathway through drinking passageway 208.

To facilitate the smooth exit of liquid, in the open configuration actuator opening sealing member 506 in some embodiments does not create a continuous seal around actuator opening 206. Seal bypass grooves 216 are shown in phantom lines in FIG. 5C (see also FIG. 6), and provide a vent pathway for air intake, such that in the open configuration actuator opening 206 is not sealed, and air can enter container 10 to replace the volume of liquid that exits through drinking passageway 208 as the user drinks. Arrow 54 shows an example air intake pathway through actuator opening 206.

As shown in the figures, tongue 504 of sealing apparatus 500 extends outward from main body 502 of sealing apparatus. As shown, tongue 504 is spaced apart from connector 510, where sealing apparatus connects to lid body 200 (in fact, in the example shown it is the part of sealing apparatus 500 that extends farthest from connector 510). This distance between drinking passageway sealing member 508 and connector 510 allows for a relatively remote control for opening and closing drinking passageway 208, enabling the convenient central positioning of actuator button 402 mentioned above. The distance can also create a challenge in creating an effective seal around drinking passageway inlet 210.

Embodiments discussed herein establish and maintain an effective seal around drinking passageway inlet 210 by sealing at an oblique angle relative to sealing apparatus 500's angle of approach. And through use of retention tabs that help support tongue 504 in contact around inlet 210.

Starting with FIG. 5C, which shows lid 20 in the open configuration, arrow 56 represents a travel axis 56 showing the direction of travel of sealing apparatus 500, which is horizontal, controlled by a user sliding actuator 400 forward or rearward. Angle 62 shows the angle at which tongue 504 (or at least the portion and surface of tongue 504 on which drinking passageway sealing member 508 is disposed) deviates from travel axis 56 of sealing apparatus 500. As shown, this portion of tongue 504 is angled downward toward the front of lid 20. The surface around drinking passageway inlet 210 shares the same angle 62, so the interface between drinking passageway sealing member 508 and drinking passageway inlet 210 it itself angled relative to travel axis 56 of sealing apparatus 500. An advantage of this configuration, relative to a sealing interface that was flat, aligned with travel axis 56, is that the entirety of the seal around drinking passageway inlet 210 is broken upon just a small movement of sealing apparatus 500 away from drinking passageway inlet 210, as opposed to needing to pass over the entire width of the inlet to be entirely free of sealing member around the inlet perimeter.

Angle 62 need not be large to achieve the above-mentioned advantages. In some embodiments, angle 62 is 5 degrees. In some embodiments, angle 62 can be from 2 to 10 degrees, or from 2 to 30 degrees.

Further, in order to help establish and maintain a strong seal around drinking passageway inlet 210, lid body 200 may include retention tabs 218. Such retention tabs 218 may extend downward from an interior surface of lid body 200, and laterally to form a shelf configured to retain tongue 504 of sealing apparatus 500 between itself and the interior surface of lid body 200. Such retention tabs 218 prevent tongue 504 from flexing away from the interior surface of lid body 200, and thus from flexing away from drinking passageway inlet 210, thereby helping to keep drinking passageway sealing member 508 in contact around drinking passageway inlet 210 when lid 20 is in the closed configuration (e.g., as shown in FIG. 5A).

Figure 6:
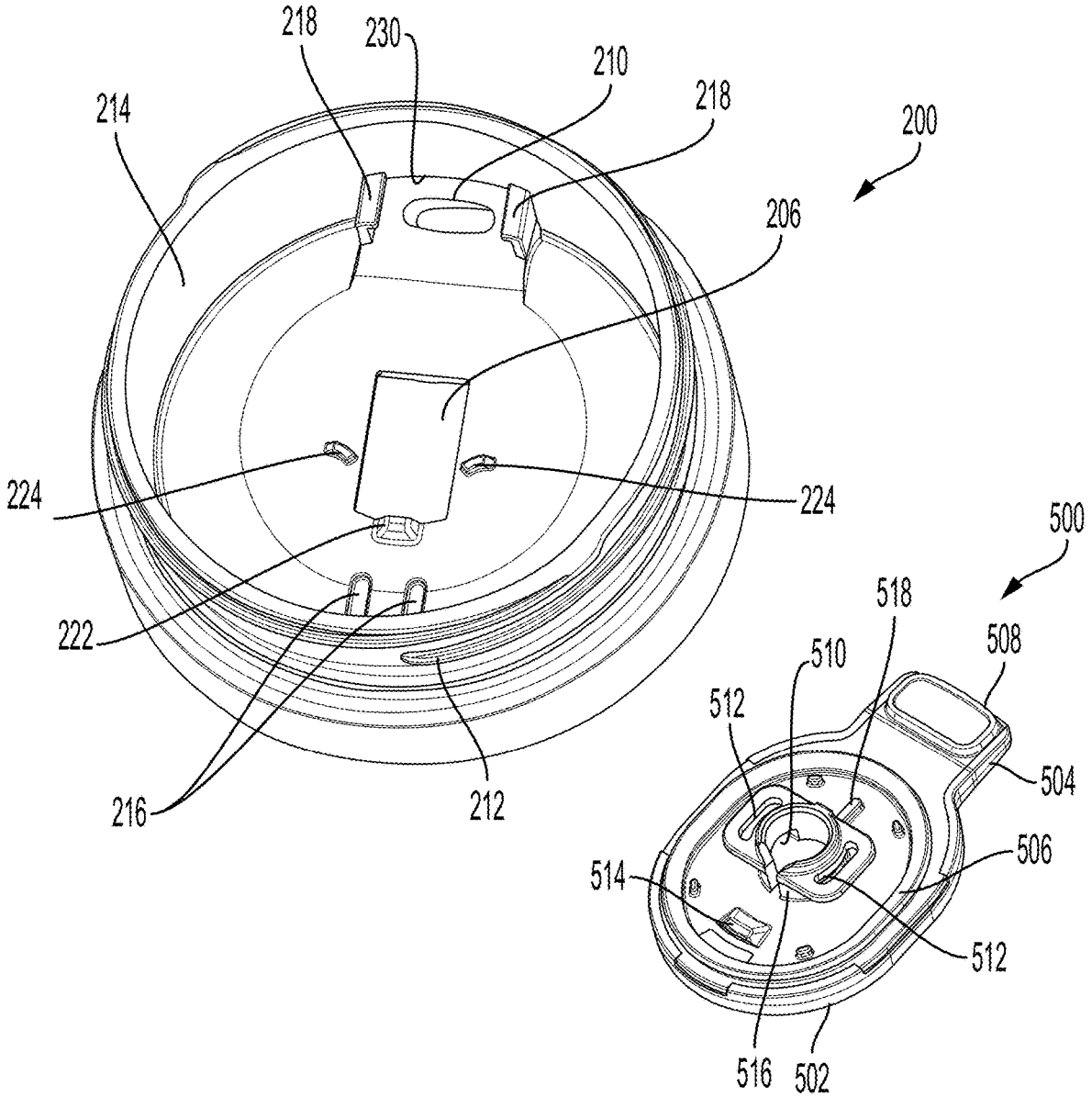
FIG. 6 shows a lower perspective view of the lid body and an upper perspective view of the sealing member of the container of FIG. 1 in a disassembled configuration.

As shown in the illustrated embodiment of FIG. 6, retention tabs 218 may extend to sidewall 214 at the front of lid body 200 (i.e., toward the side of lid body 200 with drinking passageway inlet 210). In other embodiments, there may be a gap between a portion of retention tabs 218 and sidewall 214.

In some embodiments upper lateral surfaces of retention tabs 218 are angled upward toward the front of lid 20 (i.e., toward the side of lid 20 on which drinking opening 204 is disposed). Angle 64 shows the angle at which the upper lateral surfaces of retention tabs 218 are angled relative to travel axis 56 of sealing apparatus 500. As tongue 504 of sealing apparatus 500 is slid forward over retention tabs 218, this angle raises tongue 504 upward, pressing it more firmly against the interior surface of lid body 200 around drinking passageway inlet 210, thereby creating a stronger seal.

In some embodiments, the lower surface of tongue 504 that slides over retention tabs 218 is also angled (e.g., to correspond to the angle 64 of retention tabs 218) to maintain solid and consistent contact between retention tabs 218 and tongue 504.

As shown in the illustrated embodiment (see, e.g., FIG. 4) lid body 200 may include two such retention tabs 218, one on each side of tongue 504, such that not only do the lateral-extending portions of retention tabs 218 constrain tongue 504 from below, but the downward-extending portion of retention tabs 218 constrain tongue 504 from the sides. These constraints cooperate with the shape of actuator opening 206 to limit movement of the sealing assembly to primarily translational movement between the open configuration and the closed configuration, with, in some embodiments, allowance for vertical motion of actuator 206 to un-seal actuator opening 206 and to provide clearance for actuator stop 514 of sealing apparatus 500 to bypass actuator stop 222 of lid body 200 before sliding from the open configuration to the closed configuration, as discussed elsewhere herein.

Further, in some embodiments, a shelf 230 is formed in or on an inner side of lower side wall 214 of lid body 200. Shelf 230 may form a pocket in a portion of lower side wall 214 arranged at the front of lid body 200 (i.e., below drinking passageway 208). In the closed configuration (see FIG. 5A), an end of tongue 504 is disposed on and supported by shelf 230, further holding drinking passageway sealing member 508 against the interior surface of lid body 200 around drinking passageway inlet 210 and thereby helping to maintain a strong seal. Angle 64 of retention tabs 218 and the tapered end shape of tongue 504 may help to guide the end of tongue 504 onto shelf 230.

As described, most parts of the sealing assembly are disposed within container 10—that is, on an underside or interior surface of lid body 200. Because the openings are sealed from the inside, as opposed to the outside, any pressure buildup within container 10 will serve to strengthen the effectiveness of sealing members 506 and 508, by pressing them more firmly against interior surfaces of lid body 200. Further, keeping the sealing surfaces within the interior of container 10 helps keep them from becoming dirty or contaminated by things in the outside atmosphere, and keeps them from interfering with the drinking experience—there is nothing to remove or to get in the way of simply drinking from the drinking opening.

As mentioned, in some uses pressure may build up within container 10 in the closed configuration. A pressure buildup can occur when pressure within container 10 is greater than pressure outside container 10 (e.g., atmospheric pressure). This can happen due to the characteristics of the beverage contained within container 10 (e.g., a hot beverage can build up pressure within the sealed container 10) or due to changes in external pressure (e.g., changes in elevation as container 10 travels). However it originates, it can be desirable to relieve such pressure by equalizing container 10's internal pressure with the external pressure. It can be particularly desirable to do this before the drinking passageway is opened, to prevent pressure equalization from occurring through drinking opening 204, thereby avoiding any potential for liquid or air to spurt out at the user through drinking opening 204.

FIG. 5B shows an intermediate configuration between the closed configuration of FIG. 5A and the open configuration of FIG. 5C. FIG. 5B shows a venting configuration in which drinking passageway 208 is still closed, but lid 20 establishes an air pathway between the interior and exterior of container 10 to equalize pressure before drinking passageway inlet 210 can be unsealed. Such intermediate, venting configuration (and associated features as will be described) may be included in lid 20 along with other features as described herein, it may be absent, or it may be provided independent of such other features as described herein.

In some embodiments that include an intermediate, venting configuration, features of lid 20 require lid 20 to pass the intermediate, venting configuration before fully leaving the closed configuration to go to the open configuration. When using actuator 400 as a sliding mechanism to open drinking opening 204 a user will intuitively place their finger on button 402 and slide it rearward (away from drinking opening). As a natural part of this motion, the user will also be applying downward pressure on button 402. Features of lid 20 take advantage of (and encourage) this natural downward motion to initiate the intermediate, venting position so that container 10 can equalize its internal pressure with the external pressure through a venting pathway that is separate and spaced apart from drinking passageway 208.

As shown in FIG. 3, as well as FIGS. 5A-5C, sealing apparatus 500 includes an actuator stop 514. Actuator stop 514 of sealing apparatus 500 is configured to engage with an actuator stop 222 of lid body 200 (see also, FIG. 6) to stop rearward travel of sealing apparatus 500 between the closed configuration and the open configuration, unless sealing apparatus 500 is pressed downward to bypass stops 514 and 222. This downward motion of sealing apparatus 500 will un-seal actuator opening 206 of lid body 200.

As shown in FIG. 5A, rearward motion in the direction arrow 54 of sealing apparatus 500 (to the right as shown in the figure) is stopped by the engagement of sealing apparatus actuator stop 514 and lid body actuator stop 222. To bypass stops 514 and 222, a user presses down on actuator 400 (e.g., via actuator button 402), to move it in the downward direction of arrow 58 of FIG. 5B.

As shown in FIG. 5B, the downward motion of sealing apparatus 500 may un-seal actuator opening 206 by moving actuator opening sealing member 506 away from and at least partially out of contact with the interior surface of lid body 200 around actuator opening 206. This establishes an air pathway 51 through actuator opening 206 between the interior of container 10 and its exterior atmosphere, by which pressure is equalized. The stop thus being bypassed and the container 10 vented, the user can then continue to slide actuator 400 (and thereby the sealing assembly) to move lid 20 to the open configuration shown in FIG. 5C, at which point the user may drink from container 10.

As shown, lid 20 vents through the same opening that the sealing assembly passes through. This helps to minimize the number of openings through lid body 200 (i.e., as opposed to, for example, having a separate opening for venting), which minimizes the potential pathways for leaks to occur, thereby improving the overall sealing attributes of lid 20 and container 10.

In the embodiment shown, actuator stop 514 protrudes upward from main body 502 and is disposed within actuator opening sealing member 506. And actuator stop 222 protrudes downward from lid body 200. Further, stop 514 as shown is formed integrally with and fixed relative to sealing apparatus main body 502, and stop 222 is formed integrally with and fixed relative to lid body 200. Such configurations are beneficial as providing straightforward operation and construction, but stops 514 and 222 may have other configurations or positions that effect the functions described.

In some embodiments, coupling flanges 512 (see FIG. 3) are resiliently deformable, such that they flex against lid body 200 to allow the downward motion of the sealing assembly when pressed by a user as described above. When released, coupling flanges 512 pull the sealing assembly up again, returning actuator opening sealing member to full contact with lid body 200 around actuator opening 206 (with the potential exception of seal bypass grooves 216 as described above).

As described, lid 20 can be removably attached to vessel 40 to form container 10. These parts can be separated to, for example, fill a beverage into vessel 40 before attaching lid 20, or to wash lid 20 and vessel 40 separately. It may also be desirable to disassemble parts of lid 20 to wash them. Such disassembly function and associated features as will be described may be included in lid 20 along with other features as described herein, may be absent, or it may be provided independent of such other features as described herein.

As shown in, for example, FIGS. 3 and 4, lid 20 may be disassembled into three parts: lid body 200, actuator 400, and sealing apparatus 500. This minimal number of parts helps simplify assembly and disassembly, and reduces the potential for loss or damage while cleaning.

The parts of lid 20 assembly at a single connection point with a single, intuitive assembly operation, thereby simplifying assembly and disassembly. At a high level, a portion of sealing apparatus 500 connects to a portion of actuator 400 through actuator opening 206 of lid body 200.

As shown, for example, in FIGS. 5A-5C, connector 404 of actuator 400 connects to connector 510 of sealing apparatus 500. Further, as described above, in some embodiments coupling flanges 512 of sealing apparatus extend on one side (e.g., the external, upper side) of lid body 200 and are connected by a post 516 that extends through actuator opening 206 to the rest of sealing apparatus 500 that is disposed on the other side (e.g., the internal, lower side) of lid body 200. In this configuration sealing apparatus 500 slidably connects to lid body 200 by sandwiching a portion of lid body 200 that is adjacent to or surrounds actuator opening 206 between coupling flanges 512 and main body 502.

So that the sealing assembly is slidable within actuator opening 206, actuator opening 206 may have a length in the forward-rearward direction that is larger than its width. This can allow post 516 room to move forward and rearward, thereby allowing the sealing assembly to move forward and rearward, as described above. Further, coupling flanges 512 may extend in a width direction over a wider distance than the width of actuator opening 206, so that they can keep the sealing assembly coupled to lid body 200 and be able to slide along tracks 220 of lid body 200.

FIG. 6 shows sealing apparatus 500 disassembled from lid body 200. In the figure, the bottom side of lid body 200 is shown, while the top side of sealing apparatus 500 is shown. These sides will face each other when assembled. In the assembled, facing arrangement, a guide rib 518 of sealing apparatus 500 will interact with positioning ribs 224 of lid body 200 to manage and restrict relative movement between sealing apparatus 500 and lid body 200 into an assembled arrangement (or into a disassembled arrangement).

FIGS. 7A-7D show a series of relative positions between sealing apparatus 500 and lid body 200 as they transition from a disassembled arrangement to an assembled arrangement. For ease of understanding, FIGS. 7A-7D show a bottom view of lid body 200 and sealing apparatus 500, with sealing apparatus 500 shown transparent, in particular so that guide rib 518 and coupling flanges 512 of sealing apparatus are visible, and so that positioning ribs 224 and actuator opening 206 of lid body 200 are visible.

Figure 7B:
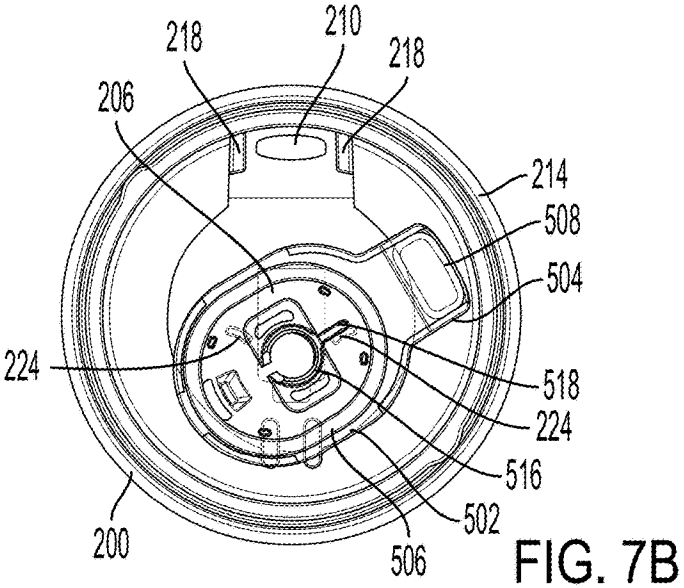
FIGS. 7A-7D show sequential views of an assembly of the lid body and an upper perspective view of the sealing member of the container of FIG. 1.
Figure 7D:
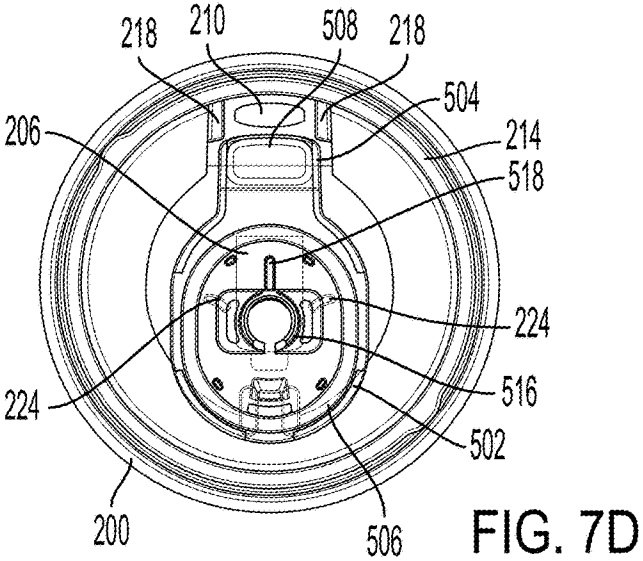
Figure 7A:
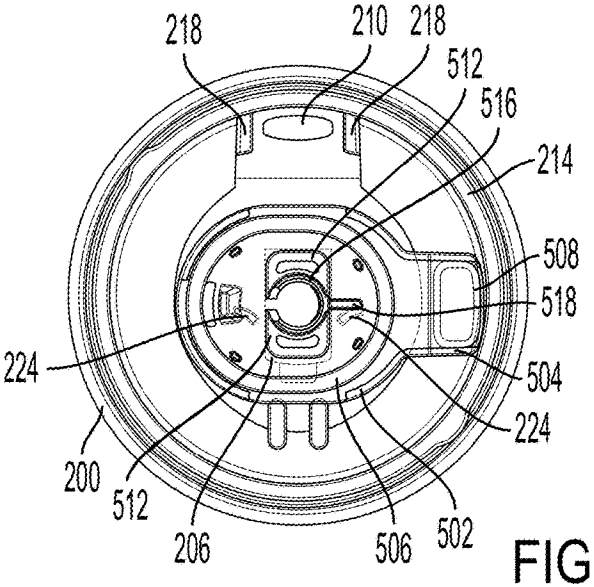

Starting with FIG. 7A, sealing apparatus 500 is positioned with coupling flanges 512 extending through actuator opening 206, and drinking passageway sealing member 508 is in contact with the interior surface of lid body 200. Coupling flanges 512 and actuator opening 206 may have complementary shapes, such that coupling flanges 512 only fit through actuator opening in this manner in limited orientations (e.g., one or two). In the illustrated example, actuator opening is a rectangular shape, with the outer extents of coupling flanges 512 defining a slightly smaller rectangular shape (with rounded corners) such that coupling flanges 512 only fit through actuator opening 206 in two orientations-one with tongue 504 pointing to the right (as shown in FIG. 7A) or one with tongue 504 pointing to the left.

In the arrangement of FIGS. 7A-7D, it will be appreciated that relative lateral motion between sealing apparatus 500 and lid body 200 will be limited by the interaction of post 516 and sides of actuator opening 206 such that post 516 (and consequently sealing apparatus 500) can only slide forward and rearward to the extent permitted by actuator opening 206, or rotate about post 516.

In the arrangement of FIG. 7A guide rib 518 and positioning ribs 224 are in the same plane, such that they will interfere with each other to further direct movement between sealing apparatus 500 and lid body 200. For example, in the assembly stage shown in FIG. 7A, guide rib 518 is positioned adjacent to a positioning rib 224. In some examples, the guide rib 518 may be positioned between two positioning ribs 224, a forward positioning rib and a rearward positioning rib. Assembly of sealing apparatus 500 and lid body 200 involves rotating sealing apparatus 500 until its tongue 504 is in line with drinking passageway inlet 210. When a user rotates sealing apparatus 500 toward this position, interaction between guide rib 518 and positioning rib 224 causes post 516 to move rearward within actuator opening 206. This brings tongue 504 away from lower side wall 214 enough that it will clear, and not interfere with, retention tabs 218 in the later stages of assembly.

Figure 7C:
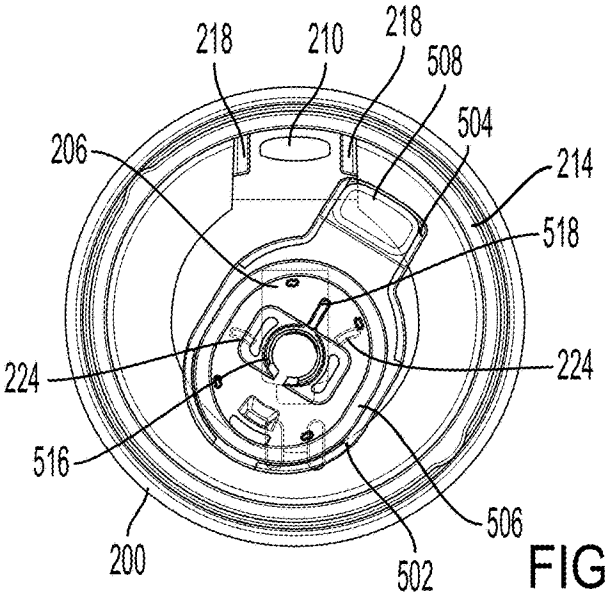

As a user continues to turn sealing apparatus 500, as shown in FIG. 7C, tongue 504 continues to turn, and the shape of positioning rib 218 directs post 516 to a rearward position within actuator opening 206. When a portion of tongue 504 has cleared a portion of retention tab 218, retention tab 218 restricts motion of tongue 504 toward lower side wall 214 until tongue 504 is aligned between retention tabs 218.

In some examples there may be a forward and rearward positioning rib, and the shape of the forward positioning rib continues to keep post 516 in its rearward position within actuator opening 206, and thus keeps tongue 504 clear of retention tabs 218. In these embodiments, the forward positioning rib restricts motion of tongue 504 toward lower side wall 214 until at least a portion of tongue 504 has cleared a portion of a retention tab 218, after which, motion of tongue 504 toward lower side wall 214 is restricted by interference between such retention tab 218 and tongue 504 (until tongue 504 is aligned between retention tabs 218).

As shown in FIG. 7D, once tongue 504 is aligned between retention tabs 218, forward and rearward motion of sealing apparatus 500 relative to lid body 200 is no longer inhibited by guide rib 518 or positioning ribs 224, but can be undertaken to the extent permitted by post 516's travel within actuator opening 206. Such motion can effect the opening, closing, and venting functions discussed in more detail above.

When assembled, the resilience of one or both of coupling flanges 512 and actuator opening sealing member 506 hold sealing apparatus 500 in place by causing actuator opening sealing member 506 to press against the interior surface of lid body 200. Disassembly can be accomplished by reversing the stages described above with reference to FIGS. 7A-7D. Such assembly and disassembly operations as have been described provide an intuitive and easy user experience, while at the same time establishing the positioning to reliably effect the transitions of the lid 20 between the open configuration, closed configuration, and venting configuration while maintaining strong seals as described.

To complete the assembly, actuator 400 may be connected to sealing apparatus 500. This connection may be established at connector 404 through a snap fit (e.g., as shown), interference fit, or other suitable reversible connection. In some embodiments, actuator 400 may not be a separate piece, but may be formed as part of sealing apparatus 500. Actuator 400 may include a guide 408 that prevents rotation of sealing apparatus while it is assembled. As shown, guide 408 extends into and across the width of actuator opening, and is spaced apart from post 516 about which sealing apparatus could otherwise rotate. Guide 408's position thus prevents such rotation, and keeps sealing apparatus 500 and tongue 504 aligned while assembled. Disassembly of actuator 400 from sealing apparatus 500 thus frees sealing apparatus 500 to rotate such that the assembly stages described above can be reversed to disassembly sealing apparatus from lid body 200.

The parts described herein (e.g., container 10, lid 20, lid body 200, actuator 400, sealing apparatus 500, or any portion thereof) may be formed of food-grade plastic (e.g., polypropylene, copolyester, the copolymer sold as Eastman Tritan, high-density polyethylene (HDPE), polyoxymethylene (POM), or acrylonitrile butadiene styrene (ABS)), or metal (e.g., steel, stainless steel, aluminum, copper, or titanium). Sealing members (e.g., actuator opening sealing member 506, drinking passageway sealing member 508, or lid sealing member 30) may be formed of a resilient material, suitable to create a seal when pressed against a surface (e.g., silicone).

It is to be appreciated that the Detailed Description section, and not the Summary and Abstract sections, is intended to be used to interpret the claims. The Summary and Abstract sections may set forth one or more but not all exemplary embodiments of the disclosed invention(s) as contemplated by the inventor(s), and thus, are not intended to limit the disclosed invention(s) and the appended claims in any way.

The foregoing description of the specific embodiments will so fully reveal the general nature of the claimed invention that others can, by applying knowledge within the skill of the art, readily modify and/or adapt for various applications such specific embodiments, without undue experimentation, without departing from the general concept of the claimed invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the claimed invention should not be limited by any of the above-described exemplary embodiments, but should be defined only in accordance with the claims and their equivalents.

What is claimed is:

1. A lid for a beverage container, the lid comprising:

a lid body defining a drinking passageway therethrough, the drinking passageway extending between a drinking opening at an upper rim of the lid body and a drinking passageway inlet at an interior of the lid body;

an actuator accessible from an exterior of the lid body; and a sealing apparatus coupled to the actuator and located at least partially in the interior of the lid body, wherein the actuator and the sealing apparatus are configured to slide relative to the lid body between a closed position in which the drinking passageway is sealed, and an open position in which the drinking passageway is not sealed, and wherein the actuator and the sealing apparatus enter a venting position in order to move from the closed position to the open position.

2. The lid of claim 1, wherein the actuator is configured to move downward relative to the lid body to enter the venting position, and to slide away from the drinking passageway to move from the closed position to the open position.

3. The lid of claim 1, wherein a sealing member of the sealing apparatus contacts an interior surface of the lid body around the drinking passageway inlet to seal the drinking passageway when the sealing apparatus is in the closed position.

4. The lid of claim 1, wherein the lid body defines an actuator opening therethrough, wherein a portion of the actuator or a portion of the sealing apparatus extends through the actuator opening to couple the actuator to the sealing apparatus, and wherein an air pathway is established through the actuator opening when the sealing apparatus is in the venting position.

5. The lid of claim 4, wherein the sealing apparatus includes a first sealing member and a second sealing member, wherein the first sealing member seals the drinking opening when the sealing apparatus is in the closed position, wherein the second sealing member seals the actuator opening when the sealing apparatus is in the closed position, and wherein the second sealing member does not seal the actuator opening when the sealing apparatus is in the venting position.

6. The lid of claim 1, wherein a stop prevents the actuator and the sealing apparatus from moving from the closed position to the open position, and wherein pressing the actuator downward moves the actuator and the sealing apparatus downward into the venting position, thereby unsealing the actuator opening and bypassing the stop.

7. The lid of claim 1, wherein when the actuator is disassembled from the sealing apparatus, the sealing apparatus is rotatable relative to the lid body to a position in which the sealing apparatus is removable from the lid body.

8. The lid of claim 1, wherein the sealing apparatus includes a sealing member that contacts an interior surface of the lid body around the drinking passageway inlet to seal the drinking passageway when the sealing apparatus is in the closed position, wherein the sealing apparatus includes a coupling flange, and wherein a lower surface of the coupling flange plate abuts an upper surface of the lid body to hold the sealing member against the interior surface of the lid body.

9. The lid of claim 1, wherein the actuator is positioned entirely below the drinking opening.

10. The lid of claim 1, wherein the actuator is positioned entirely below the upper rim of the lid.

11. The lid of claim 1, wherein a central vertical axis of the lid passes through the actuator.

12. A beverage container comprising:

the lid of claim 1; and a vessel, wherein the lid is configured to attach to the vessel to close an interior volume of the vessel.

13. A lid for a beverage container, the lid comprising:

a lid body defining a drinking passageway therethrough, the drinking passageway extending between a drinking opening positioned at a front of the lid and a drinking passageway inlet positioned at an interior of the lid body; and a sealing apparatus located at least partially in the interior of the lid body, wherein the sealing apparatus is configured to slide relative to the lid body between a first position in which the drinking passageway is sealed, and a second position in which the drinking passageway is not sealed, wherein the sealing apparatus slides away from the front of the lid along a travel axis when sliding from the first position to the second position, wherein an interior surface of the lid body around the drinking passageway inlet is angled downward toward a front of the lid, relative to the travel axis, and wherein a portion of the sealing apparatus that seals the drinking opening is angled downward toward the front of the lid, relative to the travel axis.

14. The lid of claim 13, wherein the interior surface of the lid body around the drinking passageway inlet and the portion of the sealing apparatus that seals the drinking opening are angled relative to the travel axis at the same angle.

15. The lid of claim 13, wherein the interior surface of the lid body around the drinking passageway inlet and the portion of the sealing apparatus that seals the drinking opening are angled relative to the travel axis at an angle of 2 degrees to 10 degrees.

16. The lid of claim 13, wherein the interior surface of the lid body around the drinking passageway inlet and the portion of the sealing apparatus that seals the drinking opening are angled relative to the travel axis at an angle of 5 degrees.

17. The lid of claim 13, wherein the lid body defines a shelf formed in an inner side wall of the lid body at a front of the lid body, and wherein a portion the sealing apparatus is positioned on the shelf when the sealing apparatus is in the first position.

18. The lid of claim 13, wherein the drinking opening is positioned at an upper front of a rim of the lid.

19. A lid for a beverage container, the lid comprising:

a lid body defining a drinking passageway therethrough, the drinking passageway extending between a drinking opening at an upper rim of the lid body and a drinking passageway inlet at an interior of the lid body; and a sealing apparatus located at least partially in the interior of the lid body, the sealing apparatus slidable relative to the lid body between a first position in which the drinking passageway is sealed and a second position in which the drinking passageway is not sealed, wherein a sealing member of the sealing apparatus contacts an interior surface of the lid body around the drinking passageway inlet to seal the drinking passageway when the sealing apparatus is in the first position, and wherein the portion of the sealing apparatus that contacts the interior surface of the lid body around the drinking passageway inlet when the sealing apparatus is in the first position does not contact the interior surface of the lid body when the sealing apparatus is in the second position.

20. The lid of claim 19, wherein the portion of the sealing apparatus that contacts the interior surface of the lid body around the drinking passageway inlet when the sealing apparatus is in the first position does not contact the lid body along a majority of the travel path from the first position to the second position.

* * * * *